US008858494B2

(12) United States Patent
Nelson et al.

(10) Patent No.: US 8,858,494 B2
(45) Date of Patent: Oct. 14, 2014

(54) INFUSION PUMP ASSEMBLY HAVING A REVERSE ROTATION PREVENTION SYSTEM AND METHOD FOR OPERATING THE SAME

(75) Inventors: James E. Nelson, North Branch, MI (US); Troy A. Bartz, Lake Orion, MI (US)

(73) Assignee: Curlin Medical Inc., East Aurora, NY (US)

( * ) Notice: Subject to any disclaimer, the term of this patent is extended or adjusted under 35 U.S.C. 154(b) by 413 days.

(21) Appl. No.: 13/127,524

(22) PCT Filed: Oct. 30, 2009 (Under 37 CFR 1.47)

(86) PCT No.: PCT/US2009/062661
§ 371 (c)(1), (2), (4) Date: Sep. 21, 2011

(87) PCT Pub. No.: WO2010/053831
PCT Pub. Date: May 14, 2010

(65) Prior Publication Data

US 2013/0023848 A1 Jan. 24, 2013

Related U.S. Application Data

(60) Provisional application No. 61/198,849, filed on Nov. 10, 2008.

(51) Int. Cl.
*A61M 31/00* (2006.01)
*F04B 43/00* (2006.01)
*F04B 43/08* (2006.01)
*F04B 43/12* (2006.01)
*F04B 45/06* (2006.01)

(52) U.S. Cl.
CPC ..... *F04B 43/1253* (2013.01); *F04B 43/0081* (2013.01)
USPC ..... 604/67; 417/477.6

(58) Field of Classification Search
CPC ..... F04B 43/1253; F04B 43/0081
USPC ..... 318/400.03, 560; 417/214
See application file for complete search history.

(56) References Cited

U.S. PATENT DOCUMENTS

| | | | | |
|---|---|---|---|---|
| 4,884,013 | A * | 11/1989 | Jackson et al. | 318/481 |
| 5,649,808 | A * | 7/1997 | Gruszecki et al. | 417/63 |
| 7,053,583 | B1 * | 5/2006 | Hazelton | 318/400.03 |
| 2003/0222617 | A1 * | 12/2003 | Nakai et al. | 318/701 |

* cited by examiner

*Primary Examiner* — Quynh-Nhu H Vu
*Assistant Examiner* — Jenna Zhang
(74) *Attorney, Agent, or Firm* — Hodgson Russ LLP

(57) ABSTRACT

A system and method for preventing an undesirable reverse rotation of an infusion pump assembly. The infusion pump motor includes a roller assembly, a coil, a rotor, a rotor position sensor, and a controller. The rotor is in communication with the coil, and the rotor is rotationally coupled to a roller assembly. If the pump is in not pumping, then the system monitors for reverse rotation of the pump, and if reverse rotation of the pump is detected, energizes the coil in a manner that holds the rotor in place. The system may also activate an indicator if reverse rotation is detected.

15 Claims, 2 Drawing Sheets

INFUSION PUMP ASSEMBLY HAVING A REVERSE ROTATION PREVENTION SYSTEM AND METHOD FOR OPERATING THE SAME

CROSS REFERENCE TO RELATED APPLICATION

This application is a 35 U.S.C. §371 of PCT/US2009/62661, filed Oct. 30, 2009, which claims the benefit of U.S. Provisional Application No. 61/198,849 filed Nov. 10, 2008, which is hereby incorporated by reference in its entirety. This claim is made under 35 U.S.C. §119(e); 37 C.F.R. §1.78; and 65 Fed. Reg. 50093.

TECHNICAL FIELD OF INVENTION

The invention relates to a system and method for preventing reverse rotation of an infusion pump assembly having a coil and a rotor arranged to form a motor that rotates a roller assembly.

BACKGROUND

An infusion pump infuses fluids, such as medications or nutrients, into a patient's body. Infusion pumps administer an injection every minute, or injections when requested by the patient. An infusion schedule typically consists of periods of desired flow during which the motor driving the pump is energized, and periods when the desired flow rate is zero. During zero flow periods, the motor driving the pump is de-energized. De-energizing the motor when the flow rate is zero saves energy, a particularly beneficial feature when the infusion pump is operating on battery power.

Many infusion pumps use a peristaltic type pump where a roller assembly moves a roller to progressively compress a tube through which the fluid flows. When the motor is de-energized, it is undesirable for the roller assembly to rotate backward as this may siphon blood out of the patient. Normally, the stiction of the roller assembly and related motor are sufficient to prevent reverse rotation of the pump. However, some infusion methods, subcutaneous for example or other conditions, such as a pinched tube, may produce relatively high pressures, pressures sufficient to rotate the roller assembly in backward. Various mechanical mechanisms that prevent reverse pump rotation such as pawls and clutches are known. However if the pawl gets stuck, or the clutch does not engage, the roller assembly may rotate backward. Infusion pumps used on human patients are certified to have no single point of failures. That is, no single cause of failure should cause the pump to silently fail to operate correctly. Mechanical devices are not well suited for detecting a failure such as reverse rotation and reporting that a failure has occurred.

What is desired is a way to detect reverse rotation of an infusion pump, and make energy efficient use of a motor to prevent reverse rotation. It is further desired that if reverse rotation is detected, an indicator is activated.

SUMMARY

In one aspect, this invention provides an infusion pump assembly having a reverse rotation prevention system. The infusion pump assembly includes a roller assembly configured to rotate forward to pump fluid at a flow rate. The assembly also includes a coil configured to generate a coil field in response to a coil voltage, and a rotor configured to generate a rotor field that cooperates with the coil field to urge the rotor toward a rotor position. The coil and rotor are arranged to cooperate and form a motor. The rotor field has a polarity that is dependent on the rotor position. The rotor is rotationally coupled to the roller assembly such that when the rotor is urged toward a rotor position the roller assembly is urged toward a corresponding roller assembly position. The rotor position is determined by a rotor position sensor arranged to output a rotor position signal indicative of the polarity. The infusion pump assembly also includes a controller adapted to receive an infusion schedule to determine the flow rate based on the infusion schedule, and receive the rotor position signal to determine the coil voltage based on the flow rate. The coil voltage is turned on to rotate the roller assembly forward when the flow rate is not zero, turned off when the flow rate is zero. Following the coil voltage being turned off, if the position signal indicates a change in the rotor position, then the coil voltage is turned on to hold the rotor in place and thereby prevent reverse rotation of the roller assembly.

In another aspect, this invention provides a method for operating an infusion pump infusion pump assembly having a reverse rotation prevention system. The infusion pump assembly includes a roller assembly that is rotated forward to pump fluid at a flow rate based on an infusion schedule, a coil that receives a coil voltage to generate a coil field, a rotor that generates a rotor field to cooperate with the coil field for urging the roller assembly to a roller assembly position. The method includes the steps of determining a flow rate base on the infusion schedule, and if the flow rate is not zero, the coil voltage is turn on to rotate the roller assembly forward. If the flow rate is zero, the coil voltage is turned off, and the roller assembly is monitored for movement. If a change in the roller assembly position is determined when the flow rate is zero, then a coil voltage effective to hold the rotor in place is output by the controller to prevent reverse rotation of the roller assembly.

Further features and advantages of the invention will appear more clearly on a reading of the following detail description of the preferred embodiment of the invention, which is given by way of non-limiting example only and with reference to the accompanying drawings.

BRIEF DESCRIPTION OF THE DRAWINGS

Features and advantages of embodiment(s) of the present disclosure will become apparent by reference to the following detailed description and drawings, in which like reference numerals correspond to similar, though perhaps not identical components. Reference numerals having a previously described function may or may not be described in connection with other drawings in which they appear.

DETAILED DESCRIPTION

Figure 1:
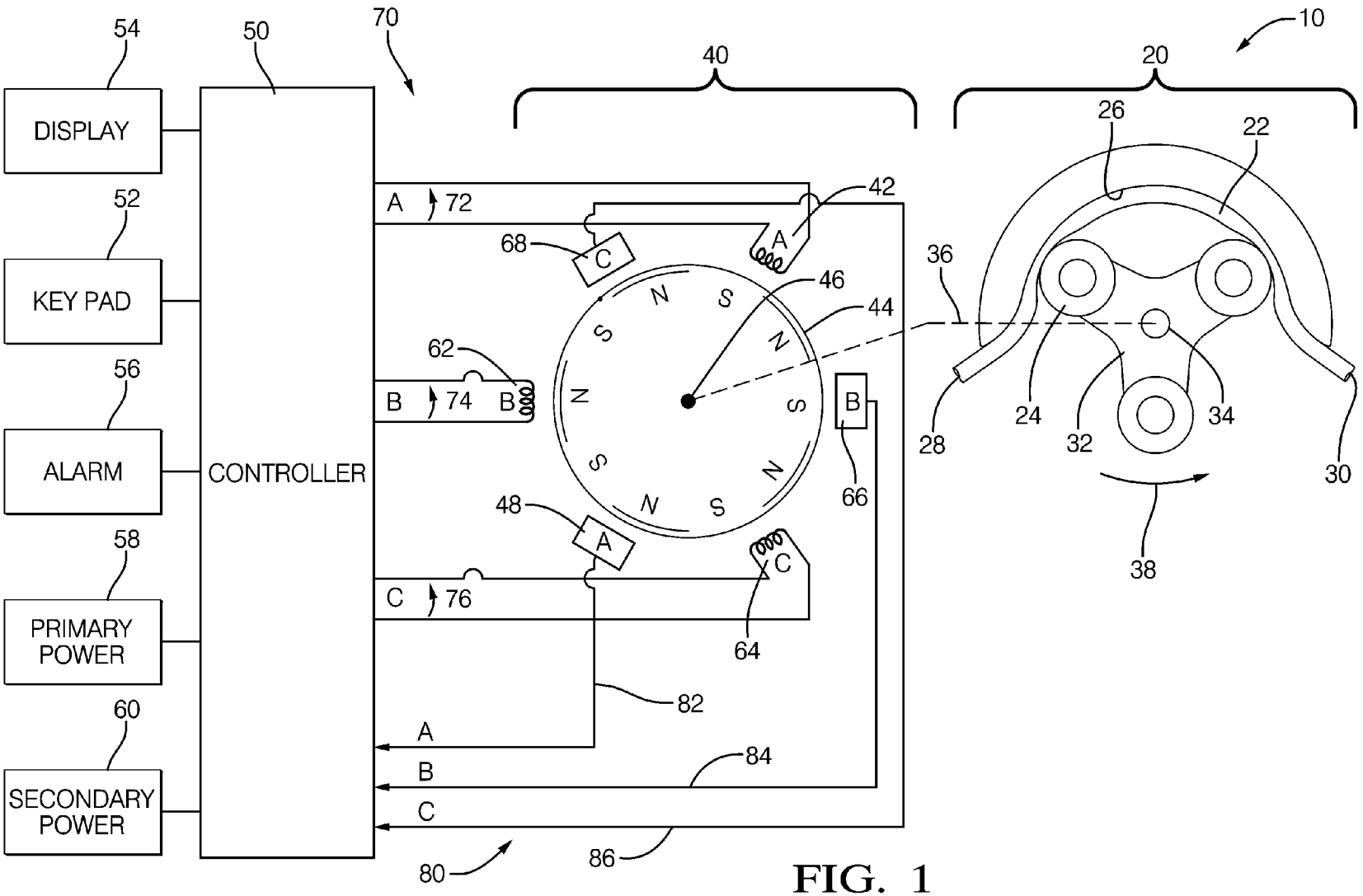
FIG. 1 is a schematic diagram of an infusion pump assembly.

Referring to FIG. 1, in accordance with a preferred embodiment of this invention, an infusion pump assembly 10 having a reverse rotation prevention system is illustrated. Infusion pump assembly 10 is useful for infusing fluid based medications or nutrients into a patient. Reverse rotation prevention is desirable to prevent fluid or blood from being siphoned out the patient. Infusion pump assembly 10 includes a roller assembly 20, also known as a peristaltic pump. Roller assembly 20 pumps fluid by progressively compressing a flexible tube 22 with a roller 24 against track 26. Tube 22 is constrained within track 26 such that as roller 24 progresses along tube 22, fluid is forced out of tube outlet 28. Tube 22 is formed of an elastic material such that it returns to its original dimensions once roller 24 passes, whereupon fluid enters tube inlet 30. Roller assembly 20 is illustrated showing three rollers arranged on a flange 32 so at least one roller is compressing tube 20 against track 26 for any flange 32 position. Alternately, two rollers may be used by extending track 26 so at least one roller is compressing tube 22. Alternately, more than three rollers may be used. Using three rollers and track 28 having about a 180 degree arc provides an arrangement where tube 22 is readily inserted and removed by retracting track 26. The features for retracting track 26 are not shown. Fluid is pumped out of outlet 28 when input shaft 34 is rotated in a forward direction indicated by arrow 38. The flow rate of fluid out of outlet 28 is proportional to the rotational rate of roller assembly 20, provided that the backpressure at outlet 28 is not sufficient to overcome the seal created by roller 24 compressing tube 22 against track 26.

Roller assembly 20 has an input shaft 34 coupled to motor assembly 40 by way of mechanical coupling 36 illustrated as a dashed line. It is preferable that mechanical coupling 36 provide a reduction ratio such that each full rotation of roller assembly requires more than one full rotation of motor assembly 40. A reduction ratio is advantageous because a smaller, faster rotating motor can be used to generate adequate torque and rotational speed for roller assembly 20. Furthermore, as described in more detail below, since motor assembly 40 is used to detect reverse rotation a small degree of reverse rotation by roller assembly 20 causes a readily detected larger degree of reverse rotation at motor assembly 40. An exemplary reduction ratio is 28:1, however it is understood that a wide range of reduction ratios could be employed to provide a usable infusion pump assembly 10. Mechanical coupling 36 is preferably by way of a gear or set of gears. Gears provide a rigid, non-slip coupling so for each rotary movement of motor assembly 40 there is a corresponding rotary movement of roller assembly 20.

Motor assembly 40 is preferably a brushless direct current (BLDC) motor. U.S. Pat. No. 7,053,583 to Hazelton shows a system and method for operating a brushless direct current motor, the disclosure of which is incorporated herein by reference. Motor assembly 40 has a coil 42 configured to generate a coil field in response to a coil voltage 72. Coil voltage 72 may be a continuous voltage, or a pulse-width-modulated voltage, either applied by a full-wave motor drive as shown in Hazelton, or a half-wave drive where one terminal of coil 42 is fixedly connected to a first voltage potential, and the other terminal is switchably coupled to a second voltage potential. As used herein, turning off a coil voltage means the same as setting the coil voltage to zero, or not outputting a coil voltage. When a coil voltage is turned off, the coil will not have any current and so will not generate a coil field. Not outputting a coil voltage may be by open-circuiting one or both connections to coil 42, or by shorting together both connections to coil 42. Coil 42 is typically part of a stator assembly having more than one coil. As used herein, coil voltage may be refer to a single voltage such as coil voltage 72, or may be a combination of voltages 72, 74, and 76, where the combination is referred to as coil voltage 70. As such, if coil voltage 70 is turned off, all of coil voltages 72, 74, and 76 are turned off. Alternately, if coil voltage 70 is turned on, one or two of the coils may have a voltage being applied, and no voltage is being applied to the remaining coil(s). Referring to Hazelton, it is understood that coil voltage 70 necessary for rotor 44 to hold in place is not the same coil voltage 70 necessary to rotate rotor 44 forward.

Motor assembly 40 also includes a rotor 44 configured to generate a rotor field. Rotor 44 is preferably a permanent magnet having an even number of distinct regions of alternating magnetic polarity uniformly spaced about the surface of rotor 44. Rotor 44 is illustrated as having ten (10) distinct regions of alternating polarity fields. Motors having more than or fewer than ten (10) regions are known and may be adapted to operate suitable in an infusion pump assembly. Coil 42 and rotor 44 are arranged to form a motor. The rotor field generated by rotor 44 cooperates with the coil field generated by coil 42 to urge rotor 44 toward a rotor position. The polarity of the rotor field that interacts or cooperates with the coil field depends on the rotor position. The rotor field and coil field interact or cooperate by creating either a repelling force or attracting force based on the polarity of the coil voltage and the polarity of the rotor field. Rotor 44 has a rotor shaft 46 that is rotationally coupled to roller assembly 20 through mechanical coupling 36, as described above. As such, when rotor 44 is urged toward a rotor position, roller assembly 20 is urged toward a corresponding roller assembly position.

Motor assembly 40 also includes a rotor position sensor 48 arranged to output a rotor position signal 82 indicative of the polarity of the rotor field interacting with the coil field. Rotor position sensor 48 is preferably a device comprising a Hall effect sensor. Alternately, rotor position sensor 48 may be an optical sensor detecting alternating light and dark areas painted on rotor 44 or present on an encoder wheel attached to rotor shaft 46. Since the arrangement of alternating polarity regions is uniformly space about rotor 44, when rotor position sensor 48 is arranged opposite coil 42 as illustrated, rotor position sensor 48 detecting one polarity of rotor field is an indication that the opposite polarity rotor field is interacting with coil 42. As used herein, rotor position signal may be refer to a single signal such as rotor position signal 82, or may be a combination of signals 82, 84, and 86, where the combination is referred to as rotor position signal 80.

Infusion pump assembly 10 includes a controller 50. Controller 50 suitably includes a microprocessor, or the like, capable of inputting rotor position signal 80. Controller 50 also has suitable power devices for outputting coil voltages 70, and a memory for storing program instructions or data regarding medications. Controller 50 is adapted to receive an infusion schedule entered by a person operating or programming infusion pump assembly 10 through a keypad 52. The entries made on keypad 52 and the operating status of infusion pump assembly 10 may be indicated on a display 54. Controller 50 determines a flow rate based on the infusion schedule. The flow rate may be a continuous flow rate measured in units of volume per unit time, thereby requiring that roller assembly 20 be rotated at a constant fixed speed. Typically, the infusion schedule calls for the infusion pump assembly 10 to pump fluid on a periodic basis. The periodic infusion schedule may specify a dosage that may be delivered at some flow rate for a short time, a few seconds for example, and then wait for a longer period of time, minutes or hours for example, before another dosage is delivered. During this longer period of time infusion pump assembly 10 is put in a standby mode, such that the motor is de-energized. With the motor de-energized, the infusion pump assembly 10 is susceptible reverse rotation may occur and reverse rotation protection is advantageous.

When the infusion pump assembly 10 is operating and the flow rate is greater than zero, the controller 50 receives rotor position signal 80 and uses that signal to determine the appropriate coil voltage 70 to rotate roller assembly 20 forward. Varying the flow rate requires coil voltage 70 to be appropriately determined to rotate roller assembly 20 at a rotational rate necessary to provide the desired flow rate. If the flow rate is zero, controller 50 turns off coil voltage 70. Following coil voltage 70 being turned off, controller 50 monitors rotor position signal 80 to detect if a change in the rotor position signal 80 occurs, thereby indicating a change in the rotor position. If a change is detected, then coil voltage 70 is turned on in such a way as to hold rotor 44 in place. Coil voltage 70 is selected so motor assembly 40 generates a detent torque curve that urges rotor 44 toward a detent position where rotor 44 will stay unless the detent torque is overcome. Holding rotor 44 in place prevents reverse rotation of roller assembly 20.

Motor assembly 40 has three coils 42, 64, and 68 arranged about rotor 44 as indicate in FIG. 1. Such an arrangement is commonly called a brushless direct current motor. Brushless motors having four coils and multiples of three coils are also known. FIG. 1 shows a three-pole brushless motor, each of the three phases is arbitrarily assigned as Phase A, Phase B, or Phase C. The number of coils and the number of rotor poles determine the relationship between the rotor position signal 80 and coil voltage 70 necessary for rotating the motor in a selected direction, or holding the motor in place. As such, it is advantageous to determine the direction of rotor movement when determining a coil voltage 70 to hold rotor 44 in place. Thus, controller 50 is further adapted to determine that the change of the rotor position is indicative of reverse rotation of roller assembly 20.

Another embodiment of infusion pump assembly 10 includes an indicator 56 coupled to controller 50. Indicator 56 is preferably an audible indicator. Alternately, indicator 56 may be a flashing light, an icon on a display, or a signal sent to another location such as a centralized nursing station. Activating indicator 56 when reverse rotation of roller assembly 20 is detected avoids a silent single point failure that may prevent an infusion pump from being certified for human use. Being able to detect reverse rotation cooperates with other features directed toward certifying infusion pump assembly 10 for human use. Reverse rotation may be an indication that flexible tube 22 extending beyond outlet 28 is pinched or otherwise obstructed.

Another embodiment of infusion pump assembly 10 includes a primary power source 58 for supplying power to infusion pump assembly 10, and a secondary power source 60 for supplying power to infusion pump assembly 10 when primary power source 58 is not supplying power to infusion pump assembly 10. Primary power source 58 is suitably a wall outlet providing 110 VAC power for infusion pump assembly 10. Secondary power source 60 is suitably a battery. In the event that building power fails, or infusion pump assembly 10 is inadvertently unplugged, secondary power source 60 will help maintain the desired infusion schedule until primary power source 58 is reactivated. If infusion pump assembly 10 is equipped with an indicator, then indicator 56 may also be activated when secondary power source 60 is supplying power to infusion pump assembly 10. Activating indicator 56 when secondary power source 60 is supplying power avoids a silent single point failure, thereby cooperating with other features directed toward certifying infusion pump assembly 10 for human use.

The arrangement of coil 42, a second coil 62, and a third coil 64 illustrated in FIG. 1 is sometimes referred to as a stator or stator assembly. The physical support for the coils is not shown, but a variety of suitable supports is known. FIG. 1 illustrates the coils as being arranged to project coil fields radially inward toward the rotor 44. An alternate arrangement is the coils oriented to project field coils radially outward, and the rotor 44 is a cylindrical permanent magnet arranged to surround such a stator and project the rotor field radially inward.

The stator assembly may also support the rotor position sensor 48, a second rotor position sensor 66, and a third rotor position sensor 68. The three rotary position sensors 48, 66, and 68 are preferably Hall effect sensors arranged to determine the polarity of the rotor fields near each sensor. Rotor position sensors 48, 66, and 68 each output a polarity signal 82, 84, and 86 respectively, collectively known as rotor position signal 80. It is advantageous to include the rotary position sensor as part of the stator assembly so the rotary position sensor can directly detect the polarity of the rotor field. Alternately, the rotary position sensors may be located away from the rotor 44, and determine polarity indirectly based on an encoder attached to rotor shaft 46.

Figure 2:
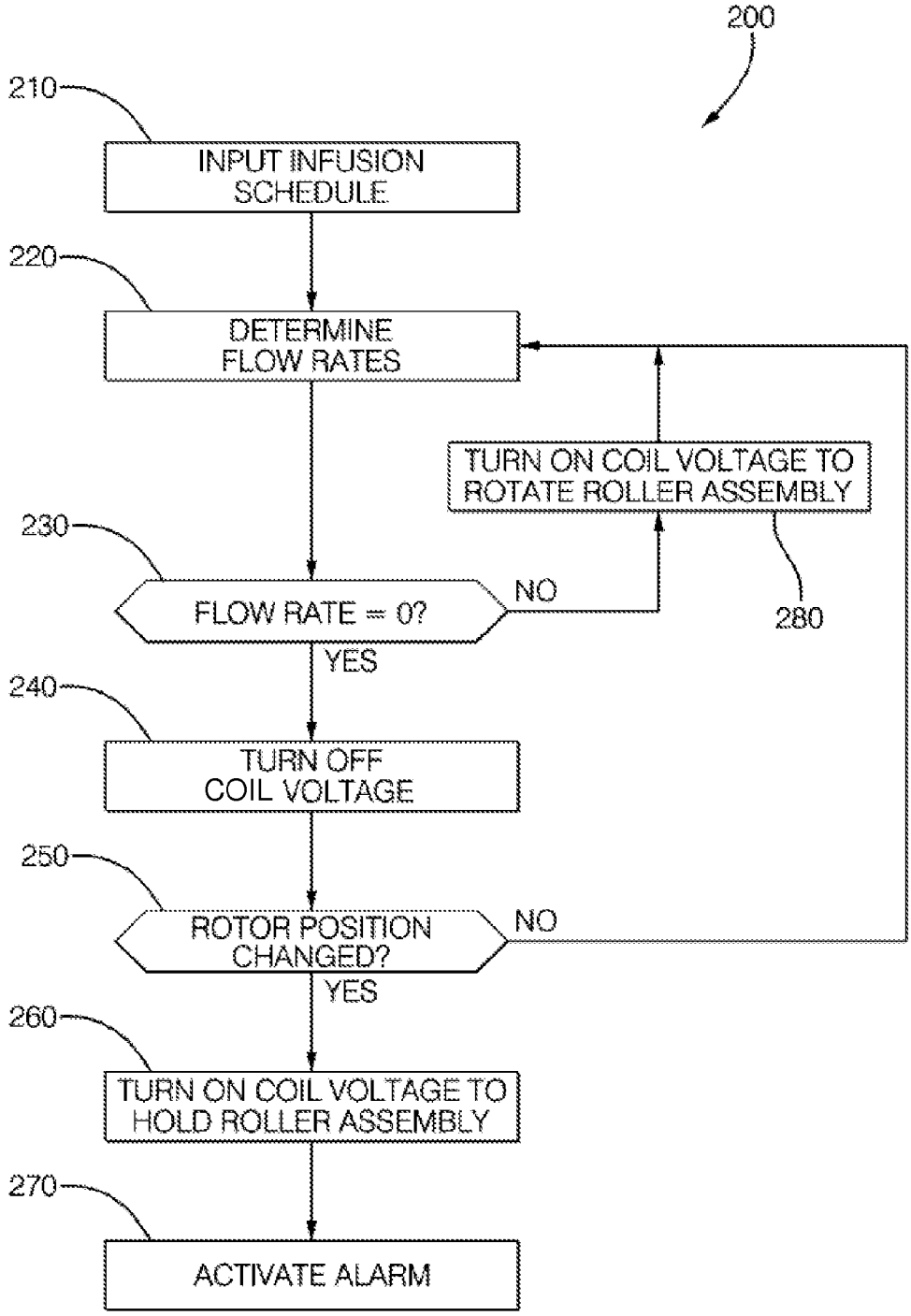
FIG. 2 is a flow chart of a method of operating the assembly of FIG. 1.

FIG. 2 is a flow chart 200 illustrating a method for operating infusion pump infusion pump assembly 10 shown in FIG. 1. At step 210 an infusion schedule is input by an operator, such as a nurse or doctor, and received by controller 50. At step 220, the controller determines the flow rate based on the infusion schedule. An infusion schedule will normally specify a dose to be delivered on a periodic basis, every hour for example. For example, the dose may require the pump to operate at some flow rate for a few seconds, followed by zero flow rate for the remainder of the hour. At step 230 a determination is made as to the flow rate value. If the flow rate is not zero, the coil voltage is turned on or output by controller 50 in a manner effective to rotate roller assembly 20 forward and pump fluid at the flow rate. If the flow rate is zero, coil voltage 70 is turned off so roller assembly 20 does not pump any fluid. At step 250, a rotor position signal output by the rotor position sensor 48 is monitored or input by controller 50 to determine if the rotor position is changing. If the rotor position does not change, the NO logic path returns to step 220 where the flow rate is again determined. If the rotor position does change, then at step 260 the coil voltage is turned on in a manner effective to hold rotor 44 in place. At step 270, the indicator 56 is activated to notify an operator that reverse rotation has been detected.

In another embodiment, the method may include activating a secondary power source 58 when a primary power source 60 is not supplying power. Secondary power source is suitably a battery and helps the pump infusion pump assembly 10 maintain the programmed infusion schedule. An indicator may also be activated if the secondary power source is supplying power. Such an action would be beneficial if for example, the primary power source 58 was a wall plug, and the primary power source had been inadvertently unplugged.

In another embodiment having three Hall effects sensor for indicating rotor position and rotor polarity, the method may include the step of determining a change in the roller assembly position by monitoring signals from three Hall effect sensors arranged about the rotor.

Therefore, an infusion pump assembly having a reverse rotation prevention system and method for operating the same is provided. The reverse rotation prevention system monitors the motor assembly that drives the pump for reverse rotation when the flow rate is zero, and if reverse rotation is detected, energizes coils in the motor assembly is such a was as to hold the motor and pump in place. This motor based reverse rotation prevention system can be used alone, or in conjunction with mechanical reverse rotation prevention or another sensor arrangement to provide redundancy to guard against single point failures. The motor based system readily detects reverse rotation and so can be used to activate an indicator. Furthermore, by turning off the motor when the flow rate is zero, energy is conserved so battery life is extended.

While several embodiments have been described in detail, it will be apparent to those skilled in the art that the disclosed embodiments may be modified. Therefore, the foregoing description is to be considered exemplary rather than limiting.

What is claimed is:

1. An infusion pump assembly having a reverse rotation prevention system, said assembly comprising:

a roller assembly configured to rotate forward to pump fluid at a flow rate;

a coil configured to generate a coil field in response to a coil voltage;

a rotor configured to generate a rotor field that cooperates with the coil field to urge the rotor from a first rotor position toward a second rotor position, said rotor field having a polarity, said rotor being rotationally coupled to the roller assembly such that when the rotor is urged toward a the second rotor position the roller assembly is urged from a first roller assembly position toward a corresponding second roller assembly position for movement of the rotor in a first direction;

a rotor position sensor arranged to output a rotor position signal indicative of the polarity; and a controller adapted to receive an infusion schedule, receive the rotor position signal, determine the flow rate based on the infusion schedule, output the coil voltage based on the flow rate and the rotor position signal, and detect a change in the rotor position signal, wherein if a change in the rotor position signal is detected when the flow rate is zero, the controller outputs a coil voltage effective to hold the rotor in place and thereby prevent reverse rotation of the roller assembly in a second direction, opposite the first direction.

2. The assembly according to claim 1, wherein the controller is further adapted to output a coil voltage effective to rotate the roller assembly forward when the flow rate is not zero, and not output a coil voltage when the flow rate is zero and no change in the rotor position signal is detected.

3. The assembly according to claim 1, wherein the controller is further adapted to determine that the change of the rotor position when the desired flow rate is zero is indicative of reverse rotation of the roller assembly.

4. The assembly according to claim 3, further comprising an indicator, wherein the indicator is activated when reverse rotation of the roller assembly is indicated.

5. The assembly according to claim 1, further comprising a primary power source for supplying power to the assembly, and a secondary power source for supplying power to the assembly when the primary power source is not supplying power to the assembly.

6. The assembly according to claim 5, further comprising an indicator, wherein the indicator is activated when the secondary power source is supplying power to the assembly.

7. The assembly according to claim 1, wherein the coil and the rotor are arranged to form a brushless direct current motor.

8. The assembly according to claim 7, wherein the brushless direct current motor has a stator comprising the coil, a second coil, and a third coil.

9. The assembly according to claim 8, wherein the rotor position sensor is a Hall effect sensor arranged to determine the polarity.

10. A method for operating an infusion pump infusion pump assembly having a reverse rotation prevention system comprising a roller assembly that is rotated forward, in a first direction, to pump fluid at a flow rate based on an infusion schedule, a coil that receives a coil voltage to generate a coil field, a rotor that generates a rotor field to cooperate with the coil field for urging the roller assembly to a roller assembly position, said method comprising:

determining a flow rate based on the infusion schedule inputted into a controller; and outputting a coil voltage by the controller effective to hold the rotor in place if a change in the roller assembly position is detected when the flow rate is zero, thereby preventing reverse rotation of the roller assembly, in a second direction, the second direction being opposite the first direction.

11. The method according to claim 10, further comprising:

outputting a coil voltage effective to rotate the roller assembly forward if the flow rate is not zero; and not outputting a coil voltage if the flow rate is zero and no change in the roller assembly position is detected.

12. The method according to claim 10, further comprising:

activating an indicator when reverse rotation of the roller assembly is determined.

13. The method according to claim 10, further comprising:

activating a secondary power source when a primary power source is not supplying power.

14. The method according to claim 13, further comprising:

activating an indicator when the secondary power source is supplying power.

15. The method according to claim 10, wherein the step of determining a change in the roller assembly position includes monitoring signals from three Hall effect sensors arranged about the rotor.

* * * * *